US007405170B2

(12) United States Patent
Kong et al.

(10) Patent No.: US 7,405,170 B2
(45) Date of Patent: Jul. 29, 2008

(54) STRETCHABLE FABRICS COMPRISING ELASTICS INCORPORATED INTO NYCO FOR USE IN COMBAT UNIFORMS

(75) Inventors: Xiangming Kong, Wilmington, DE (US); Sharon W. Birk, Wilmington, DE (US); Kevin A. Frankel, Hockessin, DE (US)

(73) Assignee: Invista North America S.A R.L., Wilmington, DE (US)

( * ) Notice: Subject to any disclaimer, the term of this patent is extended or adjusted under 35 U.S.C. 154(b) by 213 days.

(21) Appl. No.: 11/012,844

(22) Filed: Dec. 15, 2004

(65) Prior Publication Data

US 2006/0128243 A1 Jun. 15, 2006

(51) Int. Cl.
*D03D 15/08* (2006.01)
*B32B 23/02* (2006.01)
*B32B 25/02* (2006.01)

(52) U.S. Cl. ..... 442/182; 442/184; 442/199; 428/296.7; 428/193

(58) Field of Classification Search ..... 442/361, 442/184, 199, 182; 428/105, 193, 296.7, 428/300.4

See application file for complete search history.

(56) References Cited

U.S. PATENT DOCUMENTS 3,044,250 A 7/1962 Hebeler
3,188,790 A 6/1965 Hebeler
3,321,448 A 5/1967 Hebeler
3,459,845 A 8/1969 Astheimen et al.
5,011,645 A 4/1991 Thompson, Jr.
5,858,885 A * 1/1999 Hamilton et al. ..... 442/184
6,805,957 B1 10/2004 Santos et al.
2003/0186610 A1 * 10/2003 Peters et al. ..... 442/327
2004/0209051 A1 10/2004 Santos et al.

OTHER PUBLICATIONS

Kirk and Ibrahim, "Fundamental Relationship of Fabric Extensivility to Anthropometric Requirements and Garment Performance", Textile Research Journal, Jan. 1966 36(1).
ASTM D3884-01—"Abrasion Resistance Using Torary Platform Double Header Abrader", 7.02.
ASTM D5034-95—"Breaking Strength and Elongation of Textile Fabrics (Grab Test)", 7.02.
ASTM D1424-96—"Tear Resistance Falling Pendulum (Elmendorf) Apparatus", 7.01.
ASTM D0737-96—"Air Permeabilty of Textile Fabrics", 7.01.

* cited by examiner

*Primary Examiner*—Lynda Salvatore

(57) ABSTRACT

A stretchable fabric comprising NYCO fabric with about 2 to about 4 wt. % elastic, such as an elastane as LYCRA®, is disclosed. The stretchable fabric of the invention exhibits about 20 to about 50% fabric stretch, and is suitable for application in combat uniforms where mobility and comfort are desirable. The stretchable fabric maintains or exceeds substantially all military uniform standard requirements and exhibits characteristics such as breaking strength, tear resistance, air permeability and abrasion resistance similar to that of NYCO fabric. Also disclosed is a garment manufactured from the stretchable fabric, as well as methods for manufacturing, dying and finishing the stretchable fabric.

16 Claims, 2 Drawing Sheets

STRETCHABLE FABRICS COMPRISING ELASTICS INCORPORATED INTO NYCO FOR USE IN COMBAT UNIFORMS

BACKGROUND OF THE INVENTION

The invention relates to a fabric woven from composite elastic yarns, which comprise inelastic yarns of nylon and cotton and elastic yarns, and inelastic yarns comprising nylon and cotton. The elastic yarns may comprise spandex (or elastane) and more generally polyurea-urethane polymer. LYCRA® brand (from INVISTA® S.à r.l.).of spandex is such a yarn. Other elastic yarns may comprise polyester polymers in the form of bicomponent filaments. The fabric of the invention is suitable for use in the manufacture of garments used for combat uniforms as well as for civilian applications. A fabric comprising about 2% to about 4% by weight of elastic woven with 50 wt. % nylon/50 wt. % cotton yarn has been demonstrated to provide from about 20 to about 50% fabric stretch. Fabric qualities such as breaking strength, tear strength, air permeability and abrasion resistance are maintained or improved over known nylon/cotton fabrics, making the fabric of the invention desirable for applications such as military uniforms and other civilian applications. The invention also relates to methods for preparing such fabrics, and garments made from the stretchable fabrics.

1. Field of the Invention

Combat uniforms have special design and functional needs due to the wide variety of activities that the wearer is engaged in and environments that the wearer is exposed to. Combat uniforms must be designed to provide the wearer a wide range of motion in order for the wearer to perform a variety of activities. Additionally, the fabric used in combat uniforms should provide some protection for the wearer against cold or heat, chemical exposure and should also exhibit good breaking, tear and abrasion resistance for durability as well as air permeability. Further, the fabric must be capable of being dyed for camouflage purposes.

Over time, fabrics and uniform designs have been developed that are advantageous for use as combat uniforms. A particularly useful fabric that has been widely used is NYCO, a 50 wt. % nylon (such as nylon 6,6) and 50 wt. % cotton prepared by spinning the nylon staple fibers with the cotton in such a way that the modulus of the nylon is consistent with that of the cotton.

Due to the qualities of prior known fabric used in combat uniforms, the uniforms typically had to be designed to be loose and baggy on the wearer. Such loose and baggy designs, however, require more fabric than is needed which can have undesirable side effects such as increased overall garment weight. Additionally, a number of wearers of combat uniforms were of the opinion that previous known uniform designs and fabrics had too much fabric to tuck into boots yet did not have enough fabric to allow easy bending of the knees and other body areas such as the back and elbow. Also, uniform designs using Velcro® to hold sleeves in place have been found to be restricting when the wearer reaches for an object.

Studies by Kirk and Ibrahim, *Fundamental Relationship of Fabric Extensibility to Anthropometric Requirements and Garment Performance*, Textile Research Journal, January 1966 36(1), the disclosure of which is incorporated by reference, measured strain areas of the body in the knee, seat, back and elbows by studying skin stretch at regular intervals. They determined that local skin stretch can vary from 15% to 50% for these body areas.

Based on extent of skin stretch, fabric stretch levels necessary to accommodate skin stretch can be determined. Garment design parameters bear on this determination. For example, conforming body garments require greater fabric stretch levels than looser fitted garments. Factors to be considered include fabric friction, contact points of the garment with the body, fabric stiffness and fabric stretch.

2. Description of Related Art

NYCO fabrics are made with staple yarns of cotton blended with specially engineered nylon staple fibers. NYCO staple yarns and methods of making and using such yarns have been previously disclosed in U.S. Pat. Nos. 3,044,250, 3,188,790, 3,321,448 and 3,459,845 issued to Hebeler; and 5,011,645 issued to Thompson, Jr., the specifications of which are incorporated by reference. The specially engineered nylon fibers have been found to have an equal or superior load-bearing capacity at the break-elongation characteristic of the natural fiber with which it is blended comparable to that of the natural fiber, improving the strength of blends of cotton and the high load-bearing nylon staple. This in turn provides substantial improvement in abrasion resistance and pilling resistance over previously known nylon/cotton blends.

NYCO fabrics continue to be used today for combat uniforms. For example, U.S. Pat. No. 6,805,957, issued to Santos et. al., and U.S. Patent Application Publication No. U.S. 2004/0209051 A1, in the name of Santos et. al. (together, "Santos"), the specifications of which are incorporated by reference, disclose camouflage pattern systems for military and civilian applications as well as techniques for printing the camouflage pattern onto fabric. The preferred fabric disclosed in Santos comprises a NYCO fabric of approximately 50±5% polyamide (nylon type 6,6 manufactured by INVISTA S.à.r.l. as type 420, with a denier per filament of between 1.6-1.8), with the remaining percentage combed cotton. It is also disclosed that other cellulosic fibers, such as Lyocell, can be used instead of cotton. The preferred weave is left-hand twill or twill derivative, although it is disclosed that other weaves may be used. The disclosed weight of the preferred fabric is 6.0-6.6 oz/yd$^2$. (203 g/m$^2$ to 224 g/m$^2$).

SUMMARY OF THE INVENTION

The invention relates to a new stretchable fabric for use in manufacture of combat uniforms and other applications where mobility, tear resistance, air permeability and abrasion resistance are desirable.

It is an object of the invention to provide a stretchable woven fabric comprising about 2% to about 4 wt. % elastic such as elastane (otherwise referred to as spandex) yarns, with the remainder of the fabric a NYCO fabric comprising approximately 50 wt. % nylon and 50 wt. % cotton yarns. The resulting fabric exhibits around 20% to 50% fabric stretch.

It is further an object of the invention to provide a stretchable woven fabric comprising about 2% to about 4 wt. % elastic such as elastane yarns, with the remainder of the fabric a NYCO fabric comprising approximately 50 wt. % nylon and 50 wt. % cotton yarns and having about 20% to 50% fabric stretch that exhibits breaking strength of greater than about 160 lbs. in the warp direction and greater than about 60 lbs. in the fill direction.

It is further an object of the invention to provide a stretchable woven fabric comprising about 2% to about 4 wt. % elastic such as elastane yarns, with the remainder of the fabric a NYCO fabric comprising approximately 50 wt. % nylon and 50 wt. % cotton yarns and having about 20% to 50% fabric stretch, breaking strength of greater than about 160 lbs. in the warp direction and greater than about 60 lbs. in the fill direction and tear strength of greater than about 13 lbs. in the warp direction and 8 lbs. in the fill direction.

It is further an object of the invention to provide a stretchable woven fabric comprising about 2% to about 4 wt. % elastic such as elastane yarns, with the remainder of the fabric a NYCO fabric comprising approximately 50 wt. % nylon and 50 wt. % cotton yarns and having about 20% to 50% fabric stretch, breaking strength of greater than about 160 lbs. in the warp direction and greater than about 60 lbs. in the fill direction, tear strength of greater than about 13 lbs. in the warp direction and 8 lbs. in the fill direction and air permeability less than about 25 $ft.^3/min/ft.^2$.

It is yet a further object of the invention to provide a stretchable woven fabric comprising about 2% to about 4 wt. % elastic such as elastane yarns, with the remainder of the fabric a NYCO fabric comprising approximately 50 wt. % nylon and 50 wt. % cotton yarns and having about 20% to 50% fabric stretch, breaking strength of greater than about 160 lbs. in the warp direction and greater than about 60 lbs. in the fill direction, tear strength of greater than about 13 lbs. in the warp direction and 8 lbs. in the fill direction, air permeability less than about 25 $ft.^3/min/ft.^2$ and abrasion resistance of greater than 600 cycles to failure as measured by ASTM D3884-01 titled *Abrasion Resistance Using Rotary Platform Double Header Abrader.*

It is yet a further object of the invention to provide a stretchable woven fabric comprising about 2% to about 4 wt. % elastic such as elastane yarns, with the remainder of the fabric a NYCO fabric comprising approximately 50 wt. % nylon and 50 wt. % cotton yarns and having about 20% to 50% fabric stretch, breaking strength of greater than about 160 lbs. in the warp direction and greater than about 60 lbs. in the fill direction, tear strength of greater than about 13 lbs. in the warp direction and 8 lbs. in the fill direction, air permeability less than about 25 $ft.^3/min/ft.^2$, abrasion resistance of greater than 600 cycles to failure as measured by ASTM D3884-01 titled *Abrasion Resistance Using Rotary Platform Double Header Abrader* and fabric growth of less than about 7.5%.

It is yet another object of the invention to provide a garment prepared from a stretchable woven fabric comprising about 2% to about 4 wt. % elastic such as elastane yarns, with the remainder of the fabric a NYCO® fabric comprising approximately 50 wt. % nylon and 50 wt. % cotton yarns and having about 20% to 50% fabric stretch, breaking strength of greater than about 160 lbs. in the warp direction and greater than about 60 lbs. in the fill direction, tear strength of greater than about 13 lbs. in the warp direction and 8 lbs. in the fill direction, air permeability less than about 25 $ft.^3/min/ft.^2$, abrasion resistance of greater than 600 cycles to failure as measured by ASTM D3884-01 titled Abrasion Resistance Using Rotary Platform Double Header Abrader and fabric growth of less than about 7.5%.

It is yet another object of the invention to provide a garment prepared from a stretchable woven fabric comprising about 2% to about 4 wt. % elastic such as elastane yarns, with the remainder of the fabric a NYCO® fabric comprising approximately 50 wt. % nylon and 50 wt. % cotton yarns and having about 20% to 50% fabric stretch, breaking strength of greater than about 160 lbs. in the warp direction and greater than about 60 lbs. in the fill direction, tear strength of greater than about 13 lbs. in the warp direction and 8 lbs. in the fill direction, air permeability less than about 25 $ft.^3/min/ft.^2$, abrasion resistance of greater than 600 cycles to failure as measured by ASTM D3884-01 titled *Abrasion Resistance Using Rotary Platform Double Header Abrader*, fabric growth of less than about 7.5% and fabric shrinkage (or dimensional stability) of less than about 3.5%.

It is an object of the invention to provide a method for preparing a stretchable woven fabric comprising about 2% to about 4 wt. % elastic such as elastane yarns, with the remainder of the fabric a NYCO fabric comprising approximately 50 wt. % nylon and 50 wt. % cotton yarns and having about 20% to 50% fabric stretch, breaking strength of greater than about 160 lbs. in the warp direction and greater than about 60 lbs. in the fill direction, tear strength of greater than about 13 lbs. in the warp direction and 8 lbs. in the fill direction, air permeability less than about 25 $ft.^3/min/ft.^2$, abrasion resistance of greater than 600 cycles to failure as measured by ASTM D3884-01 titled *Abrasion Resistance Using Rotary Platform Double Header Abrader*, fabric growth of less than 7.5% and fabric shrinkage (or dimensional stability) of less than about 3.5%.

It is yet another object of the invention to provide a stretchable fabric that substantially meets military standards for grab strength, tear resistance, air permeability and fabric weight and provides substantially the same durability of NYCO fabrics currently used in combat uniforms.

It is yet another object of the invention to provide a stretchable fabric that substantially meets military standards for grab strength, tear resistance, air permeability and fabric weight and provides substantially the same durability of NYCO fabrics currently used in combat uniforms yet requires less fabric per garment, resulting in a less bulky, lighter weight garment than a comparable garment made of NYCO with no incorporated elastic.

It is yet another object of the invention to provide a stretchable fabric that allows for increased mobility, comfort and fit in a combat uniform as compared to current uniforms made from NYCO fabric.

These and other features of the invention can be accomplished by a new stretchable fabric for use in manufacture of combat uniforms and other applications where mobility, tear resistance, air permeability and abrasion resistance are desirable. The fabric of the invention comprises a NYCO fabric of nylon 6,6 and cotton yarns in approximately equal proportions by weight comprising about 2% to about 4 wt. % by weight of incorporated elastic. Suitable elastic includes elastane comprising polyurea-urethane polymers, such as LYCRA®. Polyester polymers may also be used as the elastic. The elastic is incorporated typically into the fill, or weft, direction of the woven fabric. The resulting fabric has been demonstrated to have approximately 20% to 50% fabric stretch, while maintaining substantially all of the tear resistance, air permeability and abrasion resistance of known NYCO fabrics with no incorporated elastic.

BRIEF DESCRIPTION OF THE DRAWINGS

These and other features of the invention will be described in further detail with reference to the following figures.

DETAILED DESCRIPTION OF PREFERRED EMBODIMENTS

The new stretchable fabric of the invention is suitable for use in manufacture of combat uniforms and other applications where mobility, tear resistance, air permeability and abrasion resistance are desirable. Currently, NYCO fabric is used in military uniforms. While NYCO fabric provides good breaking strength, tear strength, air permeability and abrasion resistance, it does not stretch and is considered a "rigid" fabric (i.e., a fabric having stretch in the range of about 5% to about 10%). Therefore, a garment made from NYCO is bulkier and loosely fitting to provide the wearer with the mobility that is desirable in a combat uniform. However, this extra bulk has been observed to increase the weight of the garment. Excess fabric is difficult to tuck into boots. Also, there has been observed to be insufficient fabric around the knee causing strain while bending the knee or back, or raising the arm. Additionally, the added weight increases fatigue on the wearer.

It has been known that biomechanical principles shed light on the interplay between fabric and garment mobility, particularly for applications such as combat uniforms where mobility during physical movement of the wearer is required. As early as 1966, Kirk and Ibrahim measured critical strain areas of the body including the knee, the seat, the back and the elbows. They measured maximum local skin strain, or stretch in the horizontal and vertical directions, at regular intervals that occurred during specific body movements. Kirk and Ibrahim determined, for example, that local skin stretch varies from about 15% to about 50% in critical body areas such as the knee while going from a stand to a sit or a stand to a deep bend; the elbow while going from a stand to a full bend; the seat while going from a stand to a sit, or a stand to bend; or the back while going from a straight arm to a raised arm, or elbow bending, or shoe tying.

By knowing the extent of skin stretch during certain activities, fabric stretch can be determined (or selected) to fit certain demands. Certain aspects of the type of garment inform this determination (or selection). For example, a garment that is meant to be worn close to the body requires more stretch than a looser fitting garment. Other factors are to be considered in addition to type of fit. For example, ratio of garment size to body size, coefficient of fabric friction, number of contact points over which the garment passes and fabric stiffness affect the desired fabric stretch. Other factors as determined by those skilled in the art may also be considered in determining (or selecting) desirable fabric stretch.

Figure 1:
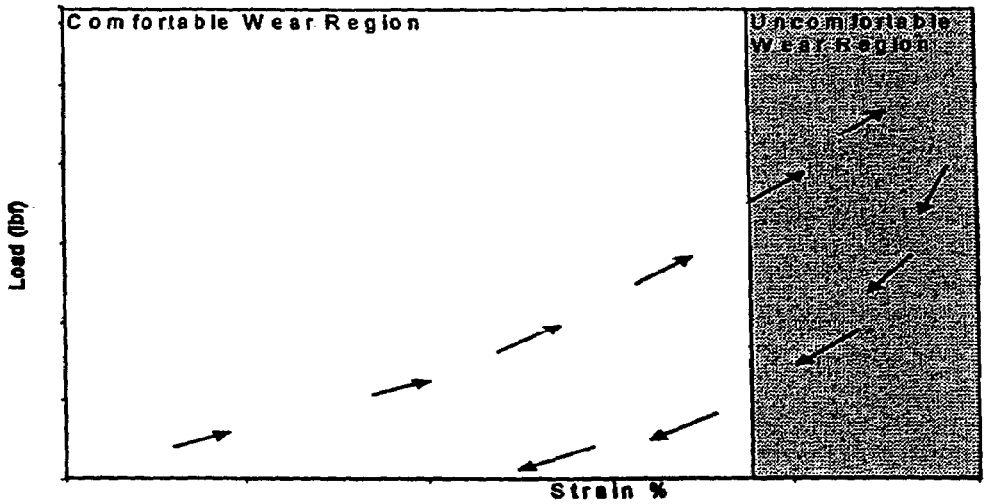
FIG. 1 is a graph depicting a typical stress-strain curve for stretch woven fabrics based on the load on the fabric.
Figure 2:
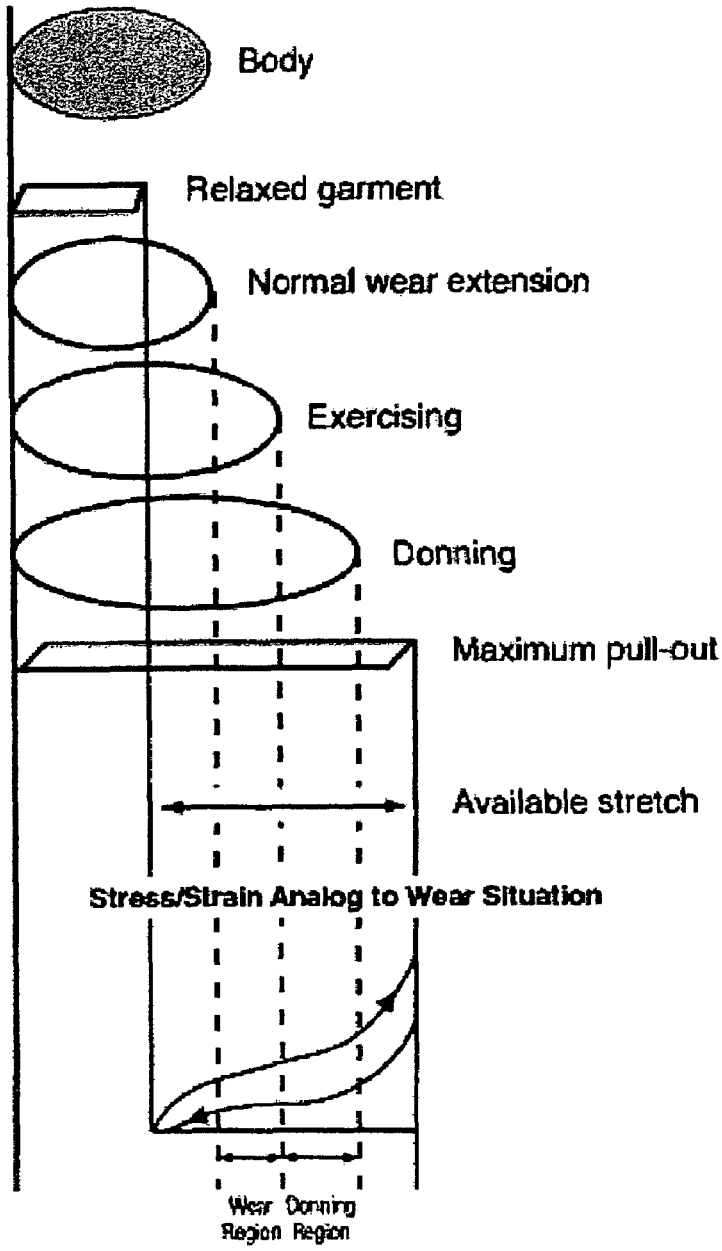
FIG. 2 is a schematic depicting the relationship between working extensions and available stretch of a garment when worn on a human body.

Studies of desired fabric stretch for combat uniforms show that at a level of 20% or greater fabric stretch, there is a rapid drop in pressure or strain on contact points of the body as compared to a rigid fabric having about 5 to about 10% fabric stretch. Accordingly, it is desirable that, to provide good mobility, a stretchable fabric be designed to function in the low stress sections of the stress-strain curve for a fabric. A typical stress-strain curve depicting comfortable and uncomfortable wear regions is shown in FIG. 1. FIG. 2 further illustrates the relationship between working extensions and available stretch of a garment when worn on a human body. Wear extension is the change in dimension that a garment will experience in actual wear. FIG. 2 illustrates that activities such as exercising and donning the garment stretch the garment beyond the normal wear extension. Accordingly, the stress-strain curve for the garment shows that normal wear falls in the comfortable region of the stress-strain curve, while donning falls within the uncomfortable wear region of the stress-strain curve and exercise falls between these two regions. It has been found that, for combat uniform applications, a garment comprising stretchable fabric with stretch of up to about 50% provides adequate available stretch so that substantially all of the working extensions fall in the flat region on the stress-strain curves, thus providing a comfortable fit that is less restraining with good freedom of movement for the wearer. The fabrics of the invention are suitable for applications in such garments.

The fabric of the invention comprises a NYCO fabric of nylon and cotton yarn comprising about 2% to about 4 wt. % by weight of incorporated elastic. A suitable nylon is nylon type 6,6 (polyhexamethylene adipamide) manufactured by INVISTA S.à.r.l. as type 420, with a denier per filament of between 1.6-2.6. Other suitable polyamide polymers such as nylon 6 (polycaproamide), nylon 7 (polyenthanamide), nylon 11 (RILSAN®), nylon 4,6 (STANYL®), nylon 6,10 (polyhexamethylene sebacamide) and nylon 6,12 (polylaurinlactamide) can be used to blend with cotton and then to form a composite yarn with the elastic, or elastane such as LYCRA®. The selection of nylon can be chosen to effect yarn strength and ultimately fabric strength.

Suitable elastics include spandex (or elastane) and more generally comprise polyurea-urethane polymer. LYCRA® brand (from INVISTA® S.à r.l.) of spandex is such a yarn. Other elastics may comprise polyester polymers in the form of bicomponent filaments. Such polyester polymers comprise polyethylene terephthalate and polytrimethylene terephthalate. These polyester polymers comprise component portions of the bicomponent filaments in a side-by-side relationship for each bicomponent filament of the yarn. It is believed that the bicomponent multifilament yarn elasterell p (known as T400 Elasterell p from INVISTA® S.à r.l.) is suitable for use in the invention.

The elastic is covered with a companion (or covering) fiber or yarn to form a composite yarn prior to weaving with the NYCO yarn. The companion fiber may comprise the same yams as comprise the bulk of the fabric, such as NYCO fiber. Suitable composite yarns include core-spun yarns, covered yams and twisted yarns. The process of providing a protective sheath, or coating, to elastic to form a composite yarn for weaving is well known in the art. The covering protects the elastic against abrasion during weaving, stabilizes the elastic recovery during weaving and gives the resultant fabric the hand and appearance of the hard yarn, e.g., the NYCO. The resultant composite yarn is itself stretchable. Suitable composite yarns include core spun yarn having a sheath-core structure, with elastane such as LYCRA® covered with nylon/cotton blends as the sheath fiber or yarn. Other types of composite yarns can be used, such as single-covered or air-covered yarn where elastic is covered with a single staple yarn; double-covered yarn where elastic is covered with two single staple yarns; twisted yarn where elastic is twisted with two other staple yarns; or Hamel-twisted yarn where elastic is covered with a two-ply staple yarn.

The % elastic in the composite yarn depends on the composite yarn size and elastic denier. It has been found that for the target stretch levels of about 20% to about 50%, composite yams comprising T420® nylon staple fiber of 2.5 dpf and staple cut length (3.81 cm) can be blended with cotton either on a carding machine or on a drawing frame. The resultant nylon/cotton roving can then be core-spun and twisted with a 70 denier Type 162-C LYCRA® to form suitable composite yam for use in the invention. Composite yarns prepared using 20s (20 single cotton count) with 70 denier Type 162-C LYCRA® comprise about 6.5% elastane, and composite yarns prepared using 18s (18 single cotton count) with 70 denier Type 162-C LYCRA® comprise about 5.9% elastane. These composite yarn sizes were selected to target fabrics weighing about 6.5 to about 7.5 oz./yd.$^2$ (220 g/m$^2$ to 254 g/m$^2$). Other yarn sizes can be used as well, and those skilled in the art can select composite yarn size and elastic denier based on target fabric weight and stretch level.

The NYCO yarns may comprise a single 15s yarn or 32s/2 plied yarn, with either 2.5 dpf nylon blended with carded cotton or 1.7 dpf T420 nylon blended with combed cotton. The NYCO composition may range from about 5 weight % cotton/95 weight % nylon to about 95 weight % cotton/5 weight % nylon. Suitable stretchable fabric characteristics have resulted in a fabric woven from covered elastane comprising 18s NYCO/LYCRA® core spun yarn and NYCO yarn comprising 32s/2 plied yarn and 1.7 dpf T420 nylon blended with combed cotton. As noted in the hereinbefore-incorporated U.S. Pat. No. 3,459,845, the nylon and cotton fibers of such NYCO yarn are considered to be substantially matched in modulus when the nylon fibers have a load-elongation (modulus) value at 7% elongation which is equal or superior to that of the cotton fibers in terms of tenacity (T) expressed in grams per denier.

The composite yarns comprising elastic fiber covered with a companion yarn, as described above, are typically woven into the fill, or weft, direction of the fabric such that the total weight % of elastic in the fabric comprises about 2 % to about 4%. The composite yarns could be incorporated into the warp direction of the woven fabric, however those skilled in the art will be able to ascertain the appropriate direction for incorporation of the composite yarns. Typically, the NYCO yarn is woven into the warp direction of the fabric. A typical fabric may include about 75 to about 95 warp ends (yarns) per inch, or epi, and about 50 to about 65 weft ends (yarns) per inch, or ppi. The fabric construction may be a satin or a twill, for example a 2/1 LH twill weave. Other fabric constructions may be suitable, such as ripstop, basket weave or basic weave.

Methods for preparing the stretchable fabric of the invention are discussed below. The final properties of the fabric, such as stretch and stability, can be affected by the weaving, dying and finishing conditions. It has been found that the fabric can be woven on currently available weaving equipment, such as the SULZER TEXTIL® L5400 air jet weaving machine, available from Sulzer Ltd., Ruti, Switzerland. Typically NYCO nylon/cotton yarns are used as warp yarns. The fabric is typically plain woven with variations well known in the art, such as satin and twill. In preparing the warp beam, the NYCO staple yarn should be slashed, or sized, with sizing agent to strengthen and lubricate the yarn. Suitable sizing agents include starch, PVA (polyvinyl alcohol) or a mixture of starch and PVA. A composite yarn comprising elastane and NYCO is inserted in the filling, or weft, direction. The fabrics can be woven on either a shuttle loom or a shuttleless loom, such as a projectile loom, a rapier loom, a water-jet loom or an air-jet loom. Enough weft insertion tension should be applied to ensure that the elastic composite yarn is substantially fully extended during weaving.

Yarn size selection and fabric structural design are adjusted to achieve a stable finished woven fabric having the targeted fabric weight and stretch level. For the stretchable fabrics of the invention, an elastic weft (fill) yarn is substantially fully extended on the loom. This weft (fill) yarn will then be bulked in the relaxed state of the finished woven fabric. The reeded warp density (ends per inch, or epi), on the loom is typically smaller than a comparable rigid fabric by a factor of the desired elongation of finished fabric, plus weave take-up of the yarn, and permanent shrinkage of companion fibers. It was observed that a selvage width of at least ¾ inch on each side of a 2/1 twill woven fabric substantially reduced or avoided edge curling of the fabric during subsequent dying and finishing. A suitable fabric of the invention comprising 2×1 LH Twill weave can be prepared using yarn having about 75 to about 90 warp ends per inch and yarn having about 50 to about 65 weft ends per inch.

Following weaving, the greige fabric should be desized and scoured to remove slashing agents and weaving oils. If the fabric is to be dyed with light colors, then it should also be bleached prior to dyeing and finishing as is known in the art. It has been found that non-chloride bleaches, such as peroxides, typically provide better results in the final fabric. The fabric can be treated with a sodium hydroxide (NaOH) solution of about 35-38 Twaddell degrees on a chain mercerizing machine under tension to swell the cotton fibers giving improved luster and strength of the fabric. Excessive tension should be avoided. Typically, the fabric is extended less than about two (2) inches in the weft (fill) direction, or width, on the mercerizing machine.

After mercerizing, the fabric should be dried and heat set on a stenter frame at a width of about one (1) inch greater than the width of the unextended fabric. Typically the fabric is heat set at about 193° C. (380° F.) for about 30 seconds. The amount of stretch in the fabric can be reduced if desired by using a higher heat setting than 193° C. (380° F.) but no higher than 201° C. (395° F.), or by drying the fabric for a longer time than 30 seconds. Also, the fabric may be stretched to a slightly wider width, but no more than about 110% of the fabric width during drying to reduce the stretch in the final fabric. However, as is known to the skilled person, the fabric will lose some stretch during the printing process. For example, fabrics printed by screen printing have been found to lose 3%-5% of their stretch permanently.

Dyeing and finishing methods for the fabric of the invention are provided. Combat uniforms are typically printed in camouflage, for example woodland or desert camouflage. Depending on the desired camouflage pattern, different dying techniques may be used as is known in the art, for example batch process and continuous ranges. In a batch dyeing process, the woven fabric is typically prepared and then dyed in a jig dyer. Other scouring and dyeing machines, such as jet dyers and Beck (or winch) dye machines, can be used. The fabric is ready for pattern printing on an ink-jet printer after it has been treated to remove the sizing agent, scoured with detergent, optionally bleached with peroxide, and heat set. Other means for pattern printing known to the skilled person can also be used, such as screen printing or heat transfer printing. Optionally, these same NYCO/elastane fabrics can be dyed to a solid color using acid dyes for the nylon component and direct dyes (e.g. VAT dyes) or reactive dyes for the cotton component. As is known in the art, either a two-step process or a one-step union dye process accomplishes the solid color option.

In a continuous dyeing process, the fabric is first desized to remove the sizing agent put on the warp before weaving, scoured with detergent to wash off the dirt, tints and oils from the fabric. Fabric that is to be dyed or printed with light colors, such as desert camouflage pattern, are bleached with peroxides. Hypochlorite-based bleaches should be avoided generally. Where the fabric is to be dyed or printed with dark colors, the bleaching option can be deleted. Following scouring and pretreating, the fabric is contacted with sodium hydroxide (NaOH) solution of 35-38 degrees Twaddell (hydrometer specific gravity is equal to (5×Twaddell degrees+1000)/(1000). Contacting with NaOH is performed on a chain mercerizing machine under tension to swell the cotton fibers for better luster and improved strength. On the mercerizing machine, the fabric is extended no more than 2 inches (5 cms) in the width direction. Following mercerizing, the fabric is dried and heat set as previously discussed. For fabric to be printed with a camouflage print, the prepared fabric is dyed to a base color suitable for camouflage printing on a continuous dye range suitable for cotton rich fabrics. Optionally, the fabric is dyed with acid dyes or VAT dyes on the continuous range following conventional dyeing procedures. The fabric dyed to a base color is then transferred to a screen printing machine for camouflage printing. Other known printing machines can be used, such as an ink-jet printing machine or a heat transfer printing machine.

It has been found that the fabric of the invention can be dyed and finished using typical commercial equipment with several minor modifications. For example, tension on the fabric, and particularly in the weft (fill) direction, should be monitored and minimized to improve final stretchability in the fabric. It has also been observed that better results are obtained when extreme acidic or alkaline conditions are avoided. Those skilled in the art will be able to adjust parameters according to the specific equipment being used to dye and finish the fabric to achieve the desired properties.

The final step is to treat the fabric on a sanforizing machine for preshrinking, which has been observed to enhance their dimensional stability in use.

The resulting fabric made according to this disclosure has been found to substantially meet or exceed military specifications, such as those specifications found in Military Specification # MIL-C-440340D, the details of which are herein incorporated by reference.

Additionally, the resulting fabrics have been demonstrated to have approximately 20% to 50% fabric stretch. Fabric stretch as that term is used herein means the amount of elongation caused by attaching a weight representing loads of 6 N (3.37 lb./in.$^2$) to a specimen and allowing the specimen with the weight to hang freely. The test method for measuring fabric stretch is detailed below.

Further, the measured growth of the resulting fabric is less than about 9%. Fabric growth as that term is used herein means the unrecovered stretch of a fabric that occurs during wear. The test method for measuring fabric growth is detailed below.

The breaking strength of the resulting fabric, as measured by ASTM D 5034-95 (reapproved 2001) titled *Breaking Strength and Elongation of Textile Fabrics* (*Grab Test*), the disclosure of which is incorporated by reference, is greater than about 160 lbs. to about 220 lbs. in the warp direction, and greater than about 60 to about 120 lbs. in the fill direction.

The Elmendorf tear strength of the resulting fabric, as measured by ASTM D 1424-96 titled *Tear Resistance Falling Pendulum* (*Elmendorf*) *Apparatus*, the disclosure of which is incorporated by reference, is greater than about 13 lbs. to about 20 lbs. in the warp direction, and greater than about 7.5 to about 13 lbs. in the fill direction.

Air permeability of the resulting fabric, as measured by ASTM D 737-96 titled *Air Permeability of Textile Fabrics*, the disclosure of which is incorporated by reference, is less than about 25 ft.$^3$/min/ft.$^2$.

Taber abrasion resistance of the resulting fabric as measured by ASTM D3884-01 titled *Abrasion Resistance Using Rotary Platform Double Head Abrader*, the disclosure of which is incorporated by reference, is greater than about 600 cycles to failure and has been found in some stretchable fabrics to exceed 2000 cycles to failure.

Fabric shrinkage, or dimensional stability, as measured by the test method detailed below, is less than about 3.5%.

The resulting fabric is useful to manufacture garments where high abrasion resistance and mobility are desired. Suitable military applications include combat uniforms, chemical defense outer shells and other military working, utility and dress uniforms. Suitable civilian applications include work wear, such as law enforcement uniforms, jump suits, outer worn vests and foul weather apparel. Such work wear may be used by repair persons, construction workers or truck drivers. Those skilled in the art will be able to prepare garments using standard handling and sewing techniques, or by modifying them to account for the stretch properties of the fabric.

EXAMPLES

The following non-limiting examples further illustrate the invention:

Test Methods

ASTM methods as detailed above were used to measure breaking strength, tear resistance, abrasion resistance and air permeability.

Fabric stretch (or elongation) is measured as follows. Fabric specimens are mounted onto a static extension tester, and weights representing loads of 6 N (3.37 lb./in.$^2$) are attached to the specimen which is then allowed to hang freely. Fabric elongation is measured by determining the amount of extension over the original length of the specimen as a % of the original length of the specimen. To perform the test, three specimens are selected at a location in the fabric at least 10 cm. (4 in.) from the selvage. Each specimen measures 60×6.5 cm. (23×2.5 in.). The long dimension corresponds with the stretch direction. Each specimen is unraveled to a 5 cm. (2 in.) width, removing approximately the same number of threads on either side of the specimen. One end of the specimen is folded to form a loop, and a seam is sewn across the width of the specimen. A notch is cut into the loop. At a distance of 6.5 cm. (2.5 in.) from the unlooped edge, a mark "A" is made. At a distance of 50 cm. (2.5 in.) from the mark "A," a mark "B" is made. The specimens are conditioned for at least sixteen (16) hours at 20° C.±2° (70° F.±3°) at 65% relative humidity±2%. Each specimen is placed into the top clamp of the static tester with mark "A" at the clamp edge and the looped end hanging free. The zero mark on a ruler is aligned with mark "B." A metal pin is inserted through the specimen loop and a 30N (6.75 lb.) weight is hooked through the notch onto the metal pin. Each specimen is "exercised" three (3) times by allowing it to be stretched by the weight for three (3) seconds, and then relieving the tension by lifting the weight. The weight is then allowed to hang freely from the "exercised" specimen, and the length of the stretched specimen is measured. The stretch of the fabric is measured by the formula [1]:

$$\%\ \text{fabric elongation} = (ML - GL)/GL \times 100 \qquad [1]$$

where ML is the length between marks "A" and "B" as weighted with the 30N weight, and GL is the original length between marks "A" and "B," or 50 cm.

Fabric growth is measured as follows. The fabric first undergoes an elongation test as previously described to measure fabric stretch, or elongation. Fresh fabric specimens are then extended to 80% of the measured fabric elongation and held in this state for thirty (30) minutes. The specimens are allowed to relax for sixty (60) minutes at which point the fabric growth is measured and calculated. To perform this test, specimens are cut at least 10 cm. (4 in.) from the selvage, and measure 55×6 cm. (22×2.5 in.). The long dimension corresponds to the stretch direction of the fabric. Each specimen is unraveled to a 5 cm. (2 in.) width by removing approximately the same number of threads on either side. The specimens are conditioned for at least sixteen (16) hours at 20° C.±2° (70° F.±3°) at 65% relative humidity±2%. Two marks are made on each specimen exactly 50 cm. (20 in.) apart.

Eighty (80)% of the fabric elongation is calculated according to formula [2] as follows:

$$E@80\% = E\,\%/100 \times 0.80 \times L \quad [2]$$

where E % is the fabric elongation measured in the fabric elongation test, and L= the original length between the two marks, or 50 cm. (20 in.). However, if E @ 80% is greater than 35%, then E @80% is set to 35%. The lower clamp on the static tester is moved to the "0" mark and a specimen is clamped into both clamps. The lower clamp is moved downward until the pointer aligns with the scale equivalent of E@80% as calculated by formula [2] (but no more than 35% as noted). The clamp is fixed at this position. After thirty (30) minutes, the lower clamp is released allowing the specimen to hang freely. After sixty (60) minutes, the increase in length of the specimen is measured and growth is calculated by formula [3]:

$$\%\ \text{growth} = (L2 \times 100)/L \quad [3]$$

where L2 is the increase in length between the marks on the specimen after relaxation, and L is the original length between the marks on the specimen (i.e., 50 cm. or 20 in.).

Fabric shrinkage, or dimensional stability, is measured as follows. Fabric shrinkage is the amount of shrinkage in a woven fabric with elastic that has been subjected to laundering and drying. Marks are made on a conditioned specimen at predetermined distances from each other. After laundering and drying, the specimens are reconditioned and the distances between the marks are remeasured. The dimensional stability is then calculated as the percentage of change in the fabric's relaxed dimensions. The fabric is conditioned for at least sixteen (16) hours at 20° C.±2° (70° F.±30) at 65% relative humidity±2%. Two 60×60 cm. (23.5×23.5 in.) specimens are cut from the fabric and marked in the warp direction. The specimens are placed on a smooth surface. A template with eight (8) slits marked at the corners and at the midpoints of the edges of a square that is 40×40 cm. is used to mark the specimens. The distances between the marks in the warp and weft (fill) directions are measured. The specimens are laundered in a gentle washing cycle without prewash and spun at a water temperature of about 60° C. (140° F.) with sufficient IEC reference detergent at a level of 1 to 3 g/L, depending on water harness. The specimens are then placed into a tumble dryer. The maximum temperature of the tumble dryer is 70° C. (158° F.). The specimens are dried and removed, then laid flat and conditioned for at least sixteen (16) hours at 20° C.±2° (70° F.±3°) at 65% relative humidity ±2%. The distances between the markings are remeasured in the warp and weft (fill) directions. The shrinkage is measured according to formula [4]:

$$C\,\% = (L1 - L2)/L1 \times 100 \quad [4]$$

Where C=the shrinkage after treatment, L1=the original length and L2=the length after laundering, drying and conditioning.

Comparative Example 1

The properties of a NYCO fabric taken from a U.S. Army Large Regular Temperate Battle Dress Uniform (BDU) are depicted in Table 1. All of the properties meet or exceed MIL-C-44034D Military Specifications for combat uniforms.

Example 1

A stretchable fabric having 28.7% stretch was prepared using 32s/2 NYCO yarn at 59 epi as the warp yarn, and 18s NYCO/70D-LYCRA® core spun composite yarn at 56 ppi as weft yarn. The fabric was woven in a 2×1 LH twill weave on an air jet loom. Following weaving, the greige fabric was desized and scoured to remove slashing agents and weaving oils, and then bleached with peroxides. Following scouring and pretreating, the fabric was contacted with sodium hydroxide (NaOH) solution of 35 degrees Twaddell. Contacting with NaOH was performed on a chain mercerizing machine under tension, and the fabric was extended no more than 2 inches (5 cms.) in the width direction. Following mercerizing, the fabric was dried and heat set at about 193° C. (380° F.) for about 30 seconds. The prepared fabric was dyed to a base color suitable for camouflage printing on a continuous dye range and then screen printed with a desert camouflage pattern. This fabric then was further sanforized. The properties of the stretchable fabric of Example 1 are given in Table 1. Example 1 fabric meets or exceeds all military specifications as set out in MIL-C-44034D.

Example 2

A stretchable fabric having 36.8% stretch was prepared using 15s NYCO yarn at 56 epi as warp yarn, and 20s NYCO/70D-LYCRA® core spun composite yarn at 50 ppi as weft yarn. The fabric was woven, dyed, finished, screen printed with a desert camouflage pattern and sanforized as in Example 1. The properties of the stretchable fabric of Example 2 are given in Table 1. Example 2 fabric meets or exceeds all military specifications as set out in MIL-C-44034D except for fabric weight and breaking strength.

Example 3

A stretchable fabric having 37.4% stretch was prepared using 15s NYCO yarn at 56 epi as warp yarn, and 20s NYCO/70D-LYCRA® core spun composite yarn at 50 ppi as weft yarn. The fabric was woven, dyed, finished and sanforized as in Example 1 except that the fabric was not bleached and was screen printed with a woodland camouflage pattern. The properties of the stretchable fabric of Example 3 are given in Table 1. Example 3 fabric meets or exceeds all military specifications as set out in MIL-C-44034D except for fabric count (ppi) and breaking strength.

Example 4

A stretchable fabric having 38.2% stretch was prepared using 15s NYCO yarn at 54 epi as warp yarn and 21s NYCO/70D-LYCRA® core spun composite yarn at 54 ppi as weft yarn. The fabric was woven, dyed, finished, screen printed with a desert camouflage pattern and sanforized as in Example 1. The properties of the stretchable fabric of Example 4 are given in Table 1. Example 4 fabric meets or exceeds all military specifications as set out in MIL-C-44034D except for fabric weight and breaking strength.

Example 5

A stretchable fabric having 37.0% stretch was prepared using 15s NYCO yarn at 54 epi as warp yarn and 21s NYCO/70D-LYCRA® core spun composite yarn at 54 ppi as weft yarn. The fabric was woven, dyed, finished and sanforized as in Example 1 except that the fabric was not bleached and was screen printed with a woodland camouflage pattern. The properties of the stretchable fabric of Example 5 are given in Table 1. Example 5 fabric meets or exceeds all military specifications as set out in MIL-C-44034D except for breaking strength.

Example 6

A stretchable fabric having 44.0% stretch was prepared using 15s NYCO yarn at 54 epi as warp yarn and 22s NYCO/70D-LYCRA® core spun composite yarn at 50 ppi as fill yarn. The fabric was woven, dyed, finished, screen printed with a desert camouflage pattern and sanforized as in Example 1. The properties of the stretchable fabric of Example 6 are given in Table 1. Example 6 fabric meets or exceeds all military specifications as set out in MIL-C-44034D except for fabric weight and breaking strength.

Example 7

A stretchable fabric having 44.0% stretch was prepared using 15s NYCO yarn at 54 epi as warp yarn and 22s NYCO/70D-LYCRA® core spun composite yarn at 50 ppi as fill yarn. The fabric was woven, dyed, finished and sanforized as in Example 1 except that the fabric was not bleached and was screen printed with a woodland camouflage pattern. The properties of the stretchable fabric of Example 7 are given in Table 1. Example 7 fabric meets or exceeds all military specifications as set out in MIL-C-44034D except for fabric weight and breaking strength.

Example 8

A stretchable fabric having 39.9% stretch was prepared using 15s NYCO yarn at 54 epi as warp yarn and 21s NYCO/70D-LYCRA® core spun composite yarn at 50 ppi as fill yarn. The fabric was woven on an air-jet loom and was prepared for printing (desized, scoured and bleached) in a jig dyer. The fabric was then ink-jet printed with a developmental camouflage pattern that was neither desert nor woodland camouflage. The properties of the stretchable fabric of Example 8 are given in Table 1. Example 8 fabric meets or exceeds all military specifications as set out in MIL-C-44034D except for fabric weight and breaking strength.

TABLE 1

| | Mil. Spec. MIL-C-44034D | NYCO 2/1 LH Twill | NYCO w/ LYCRA ® 2/1 LH Twill | NYCO w/ LYCRA ® 2/1 LH Twill | NYCO w/ LYCRA ® 2/1 LH Twill | NYCO w/ LYCRA ® 2/1 LH Twill | NYCO w/ LYCRA ® 2/1 LH Twill | NYCO w/ LYCRA ® 2/1 LH Twill | NYCO w/ LYCRA ® 2/1 LH Twill | NYCO w/ LYCRA ® 2/1 LH Twill |
|---|---|---|---|---|---|---|---|---|---|---|
| Example | — | Comp. 1 | 1 | 2 | 3 | 4 | 5 | 6 | 7 | 8 |
| Stretch % | — | — | 28.7 | 36.8 | 37.4 | 38.2 | 37.0 | 44.0 | 43.4 | 39.9 |
| LY-CRA ® % | — | — | 2.65 | 2.49 | 2.81 | 3.09 | 2.22 | 2.96 | 3.27 | 3.00 |
| Fabric Wt. oz. | >6.8 | 7.2 | 7.0 | 6.7 | 6.9 | 6.8 | 6.9 | 6.6 | 6.6 | 7.12 |
| Warp Ends per inch epi | >86 | 88 | 89 | 88 | 86 | 90 | 88 | 88 | 87 | 87 |
| Weft Ends per inch ppi | >54 | 60 | 56 | 56 | 53 | 58 | 58 | 56 | 54 | 64 |
| Breaking Strength Warp lbs. | >200 | 242 | 206 | 166 | 188 | 178 | 195 | 180 | 190 | 172 |
| Breaking Strength Fill lbs. | >125 | 147 | 142 | 66 | 94 | 71 | 109 | 61 | 82 | 96 |
| Tear Strength Warp lbs. | >11 | 13.5 | 13 | 18.3 | 19.7 | 17.6 | 18.1 | 19.0 | 20.1 | 16.4 |
| Tear Strength Fill lbs. | >8 | 9 | 10.5 | 9.0 | 12.7 | 8.07 | 10.5 | 8.0 | 10.3 | 8.5 |
| Abrasion Resistance cycles | — | 592 | >2000 | 1260 | 1078 | 1145 | 1168 | 1175 | 1381 | 1255 |
| Air Permeability $ft^3/min/ft^2$ | <25 | 10.5 | 16.3 | 15.9 | 15.8 | 13.8 | 13.4 | 15.3 | 15.6 | 13.4 |
| Fabric Growth % | — | — | 4.7 | 6.6 | 7.6 | 6.8 | 7 | 7.2 | 8.8 | 5.6 |
| Fabric Shrinkage Warp % | <3 | 3.25 | 3.50 | 0.42 | 0.75 | 0.17 | −0.08 | 0.50 | 1.00 | 2.40 |
| Fabric Shrinkage Weft (Fill) % | <3 | 3.13 | 0.80 | −0.75 | −0.50 | −0.33 | −0.58 | 0.00 | −0.17 | −2.17 |

The above description is not intended in any way to be limiting, and modifications of the invention will become apparent to those skilled in the art.

What is claimed is:

1. A stretchable fabric comprising:

about 2 to about 4 wt. % elastic in the form of a composite elastic yarn comprising an elastic polymer and nylon and cotton companion fibers; and the remainder of said fabric comprising inelastic yarn spun with nylon and cotton staple fibers, wherein the nylon and cotton fibers comprising both the elastic and inelastic yarns have a substantially matched modulus, wherein further the stretchable fabric exhibits about 20% to about 50% fabric stretch as measured by the amount of elongation of the stretchable fabric by attaching a weight representing loads of 6 N (3.37 lb./in.$^2$) to the stretchable fabric and allowing the stretchable fabric with the weight to hang freely.

2. The stretchable fabric of claim 1, wherein the stretchable fabric exhibits at least about 30% fabric stretch.

3. The stretchable fabric of claim 1, wherein the stretchable fabric exhibits at least about 35% fabric stretch.

4. The stretchable fabric of claim 1, wherein the stretchable fabric exhibits at least about 40% fabric stretch.

5. The stretchable fabric of claim 1, wherein the stretchable fabric exhibits at least about 45% fabric stretch.

6. The stretchable fabric of claim 1, wherein the stretchable fabric comprises one of a satin weave, twill weave, a ripstop weave, a basket weave or a basic weave.

7. The stretchable fabric of claim 6, wherein the inelastic yarn spun from nylon and cotton staple fibers comprises a two plied yarn comprising substantially equal amounts by weight of nylon and cotton.

8. The stretchable fabric of claim 7, wherein the elastic yarn comprises elastic polymer yarns core spun with nylon and cotton yarn, wherein further the core-spun elastic polymer yarns are incorporated into the stretchable fabric during weaving of the stretchable fabric in the fill direction.

9. The stretchable fabric of claim 8, wherein the weight of the stretchable fabric is greater than about 6.5 oz./yd.$^2$.

10. The stretchable fabric of claim 8, wherein the breaking strength of the stretchable fabric as measured by ASTM D5034-95 is greater than about 160 lbf. in the warp direction of the stretchable fabric, and greater than about 60 lbf. in the fill direction of the stretchable fabric.

11. The stretchable fabric of claim 8, wherein the air permeability of the stretchable fabric as measured by ASTM D 737-96 is less than about 25 ft.$^3$/min/ft.$^2$.

12. The stretchable fabric of claim 8, wherein the stretchable fabric weight is greater than about 6.5 oz./yd.$^2$, the breaking strength of the stretchable fabric as measured by ASTM D5034-95 is greater than about 160 lbf. in the warp direction of the stretchable fabric, and greater than about 60 lbf. in the fill direction of the stretchable fabric and the air permeability of the stretchable fabric as measured by ASTM D 737-96 is less than about 25 ft.$^3$/min/ft.$^2$.

13. The stretchable fabric of claim 8, wherein the stretchable fabric shrinkage after laundering and drying is less than about 3.5%.

14. The stretchable fabric of claim 8, wherein the stretchable fabric weight is about 6.5 oz./yd.$^2$ to about 7 oz/yd.$^2$, the breaking strength of the stretchable fabric as measured by ASTM D5034-95 is about 160 to about 220 lbf. in the warp direction of the stretchable fabric, and about 60 to about 145 lbf. in the fill direction of the stretchable fabric, the air permeability of the stretchable fabric as measured by ASTM D 737-96 is about 11 ft.$^3$/min/ft.$^2$ and the shrinkage after laundering and drying is less than about 3.5%.

15. The stretchable fabric of claim 14, wherein the elastic yarn comprises polyurea-urethane polymer.

16. A garment comprising the fabric of claim 8.

* * * * *